US005638764A

United States Patent [19]

Sarvela

[11] Patent Number: 5,638,764

[45] Date of Patent: Jun. 17, 1997

[54] BOAT WASHING MEANS

[75] Inventor: Jaakko Hermanni Sarvela, Iisalmi, Finland

[73] Assignee: Starkmatic Oy, Iisalmi, Finland

[21] Appl. No.: 602,765

[22] PCT Filed: Aug. 29, 1994

[86] PCT No.: PCT/FI94/00378

§ 371 Date: Feb. 26, 1996

§ 102(e) Date: Feb. 26, 1996

[87] PCT Pub. No.: WO95/06584

PCT Pub. Date: Mar. 9, 1995

[30] Foreign Application Priority Data

Aug. 30, 1993 [FI] Finland ..... U-930438

[51] Int. Cl.[6] ..... B63B 59/00

[52] U.S. Cl. ..... 114/222

[58] Field of Search ..... 114/222, 270, 114/263; 15/DIG. 2

[56] References Cited

U.S. PATENT DOCUMENTS 3,561,391 2/1971 Locati ..... 114/222

3,800,732 4/1974 Hill ..... 114/222

*Primary Examiner*—Edwin L. Swinehart

*Attorney, Agent, or Firm*—Steinberg, Raskin & Davidson, P.C.

[57] ABSTRACT

A floating boat washing apparatus including a plurality of floats, at least two pair of rotating scrubbing brushes bearably carried and supported on support frames, a rotating bogie frame on which the support frames of the scrubbing brushes are bearably carried and a frame structure or comparable fixed construction on which the rotating bogie frame is mounted. The rotating bogie frame is mounted by means of support shafts articulated at both ends of a suspension triangle so that the bogie frame is rotatable around the transverse axis of the boat whereby the scrubbing brush pairs are movable in an upright position relative to each other.

14 Claims, 5 Drawing Sheets

BOAT WASHING MEANS

FIELD OF THE INVENTION

The present invention relates to a floating boat washing means, comprising a great number of floats, at least two pairs of rotating scrubbing brushes, and supporting frames for scrubbing brushes, on which supporting frames the scrubbing brushes have been rotatably carried.

BACKGROUND OF THE INVENTION

All kinds of vegetation is rapidly formed on the bottom of boat, which slows down the speed of the boat and increases the fuel consumption. Soiling is prevented primarily by the use of different toxic paints. The use of toxic paints is being restricted in several countries because of the environmental detriments thereof. This development has given rise to a vigorous need to have as automatic boat washing means as possible. A proper cleaning of the bottom of a boat can be performed by pulling the boat ashore but it is an expensive measure. Boat washing means floating in the water are known in the art, such as means according to patent specification U.S. Pat. No. 4,046,095, U.S. Pat. No. 4,043,286 and U.S. Pat. No. 4,007,701. According to said patents, a boat is pulled with a mechanical conveyor between a washing means located between two pontoons, in which the brushes guided by a complicated mechanism carry out the washing. Such means are complicated and expensive. Also a boat washing means according to Finnish utility model No. 574 is known. In order to operate properly, said means requires four pairs of scrubbing brushes, wherefore the structure is also relatively expensive.

OBJECT AND SUMMARY OF THE INVENTION

The objective of the present invention is to provide a boat washing means floating in the water, in which the scrubbing brushes settle so that they conform to the bottom of the boat both transversely and longitudinally to the boat to be washed. The rest of the aims of the invention and the advantages to be gained therethrough become apparent in the description of the invention.

The aims of the invention are achieved by means of a boat washing means floating in the water supported by floats and the at least four scrubbing brushes have been rotatably carried onto a frame surrounding the brush, said frame being rotatably carried on the bogie frame, said bogie frame being made to move vertically and rotate around the transverse axis of the boat. The invention is characterized in that the boat washing means comprises furthermore a rotating bogie frame, whereon the supporting frames have been bearably carried, and that the bogie frame has been attached on the frame structure of the boat washing means, or an equivalent fixed structure by means of support arms and suspension triangle articulated at both ends in that the bogie frame is rotatable around the transversal axis of the boat to be washed, whereby the scrubbing brush pairs of the boat washing means move vertically to one another.

With a boat washing means according to the present invention numerous advantages are gained. Firstly, the brushes settle lifted by the floats and guided by the bogie frame optimally conforming to the boat bottom. Secondly, the boat can be pulled through the washing means merely with the aid of two pairs of brushes without a traction winch because the bogie construction guides both pairs of brushes into contact with the bottom early at the beginning of the washing process. Thirdly, a side of the boat is washable automatically with the aid of a side brush bearably carried to the supporting frame of the scrubbing brushes proper. Fourthly, the means can be made so short and light in weight that it can be moved on wheels of its own, pulled by a car.

BRIEF DESCRIPTION OF THE DRAWINGS

The invention is described more in detail referring to an advantageous embodiment of the invention presented in the figures of the accompanying drawings, to which the invention is not exclusively intended to be confined.

DETAILED DESCRIPTION OF THE PREFERRED EMBODIMENTS

Figure 1:
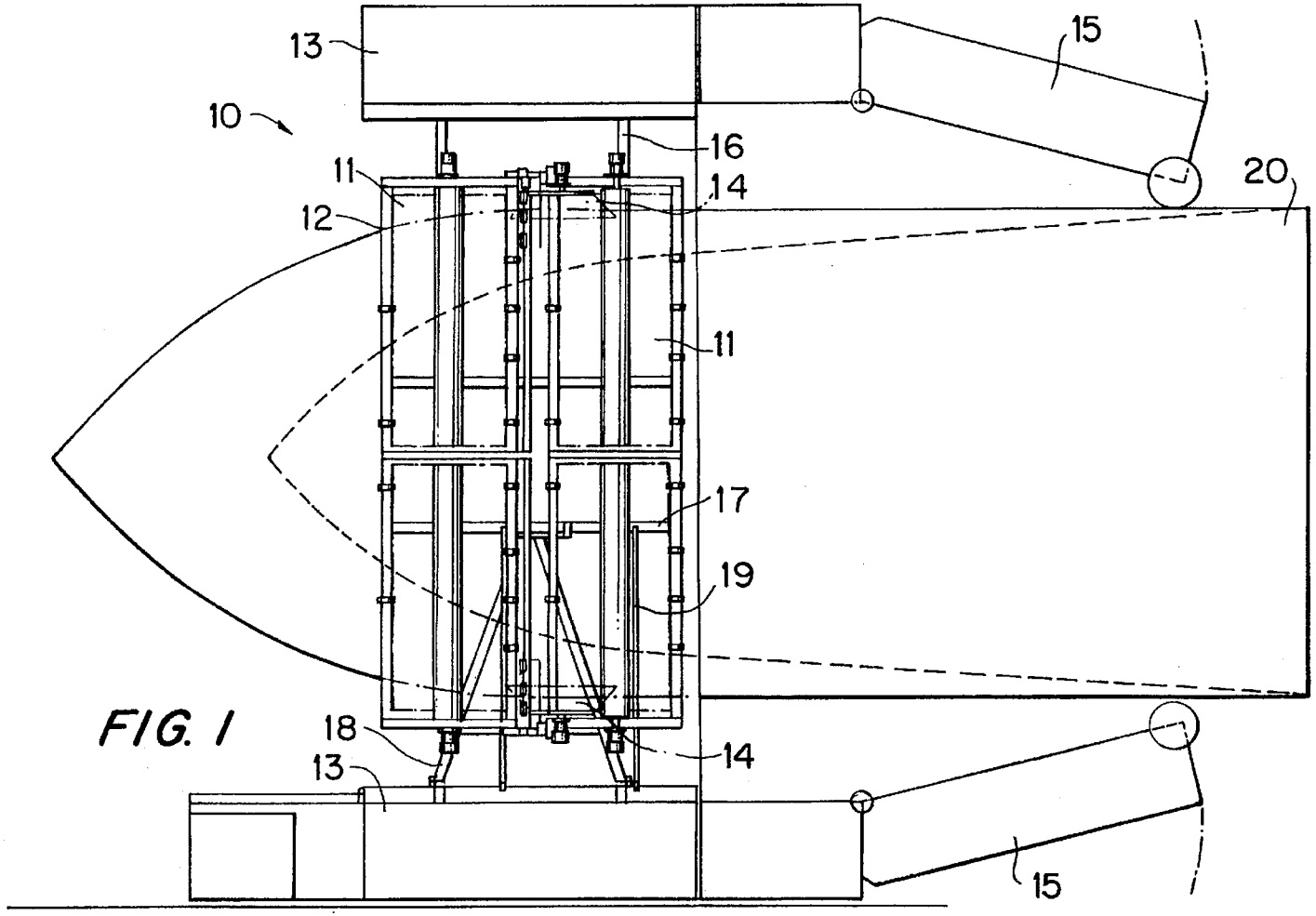
FIG. 1 presents an advantageous embodiment of the boat washing means in top view. The boat to be washed moves from the right to the left.

In the embodiment shown in FIG. 1 the boat washing means is in general indicated by reference numeral 10.

A boat washing means comprises rotating scrubbing brushes 11, supporting frames 12 for scrubbing brushes, side pontoons 13, side scrubbing brushes 14, guide beams 15, the frame structures 16, a bogie frame 17, a suspension triangle 18 for the bogie frame, and support arms 19 of the bogie frame. The boat to be washed is indicated by numeral 20. The scrubbing brushes 11 can be so placed that the longitudinal axis thereof is at right angles to the longitudinal direction of the boat, as shown in the figures, or they can be turned relative to the longitudinal direction of the boat to be e.g. in V shape.

Figure 2:
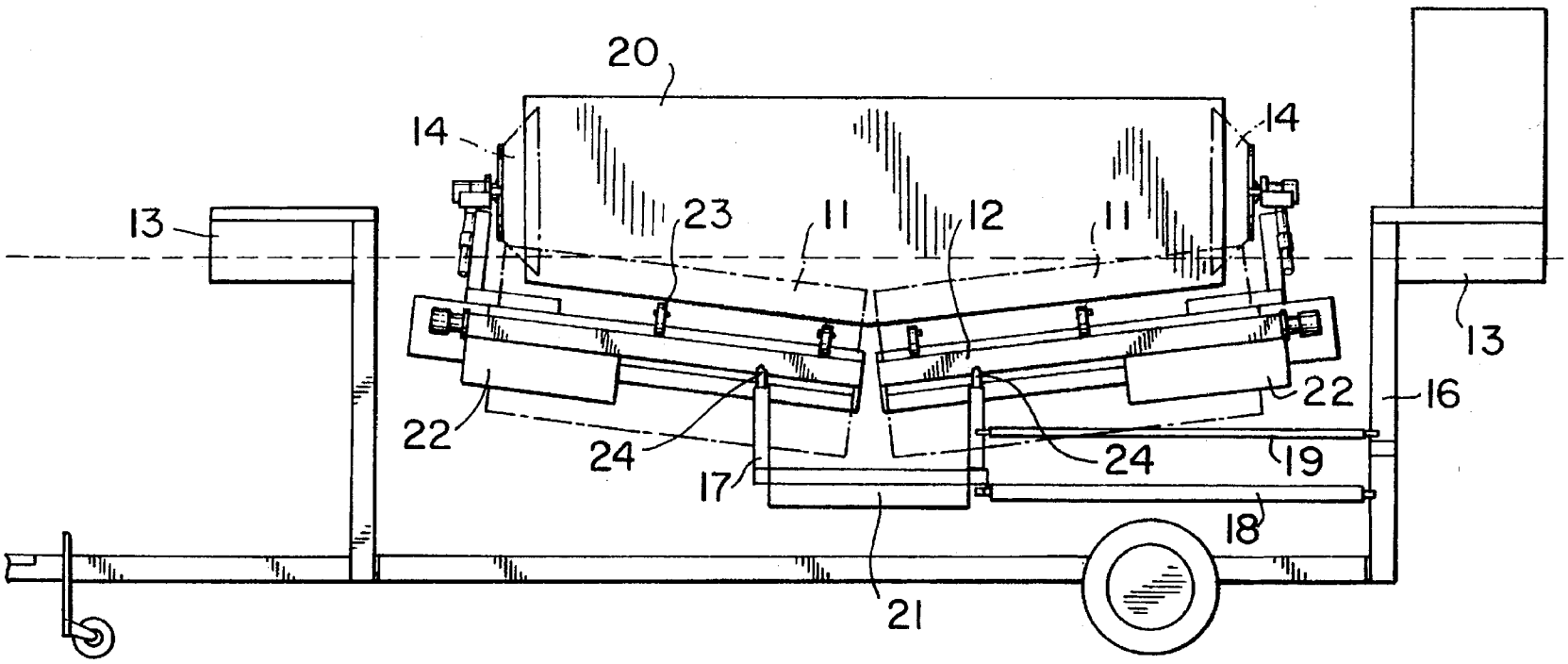
FIG. 2 presents the boat washing means in the entry direction of the boat.

FIG. 2 shows also a float 21 attached to the bogie frame 17, and floats 22 attached to the frames of the brushes, guide rollers 23 and a bearing 24 around which the brush frame 12 rotates.

Figure 3:
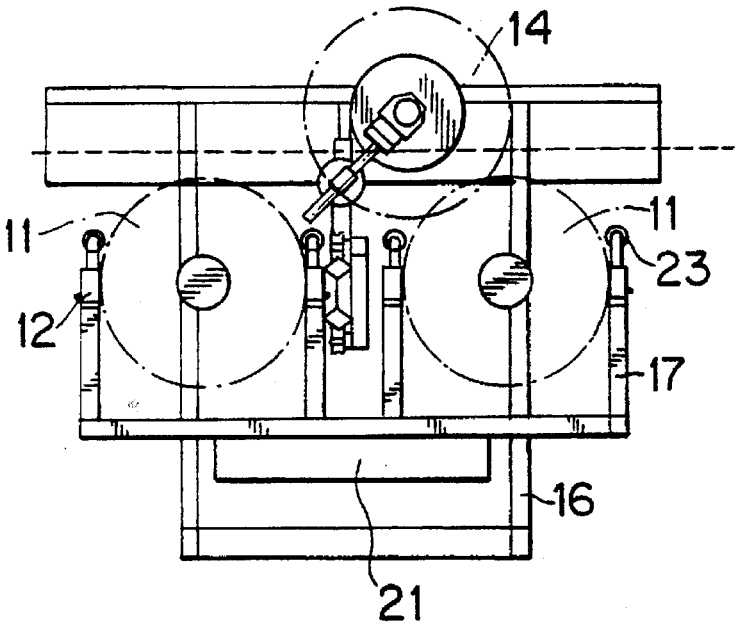
FIG. 3 presents the means in side view. The rotatable guide beams are not shown.

FIG. 3 presents how the side scrubbing brush 14 has been bearably carried onto the brush frame 12 and how the brush frame 12 has been bearably carried to the bogie frame 17.

Figure 4:
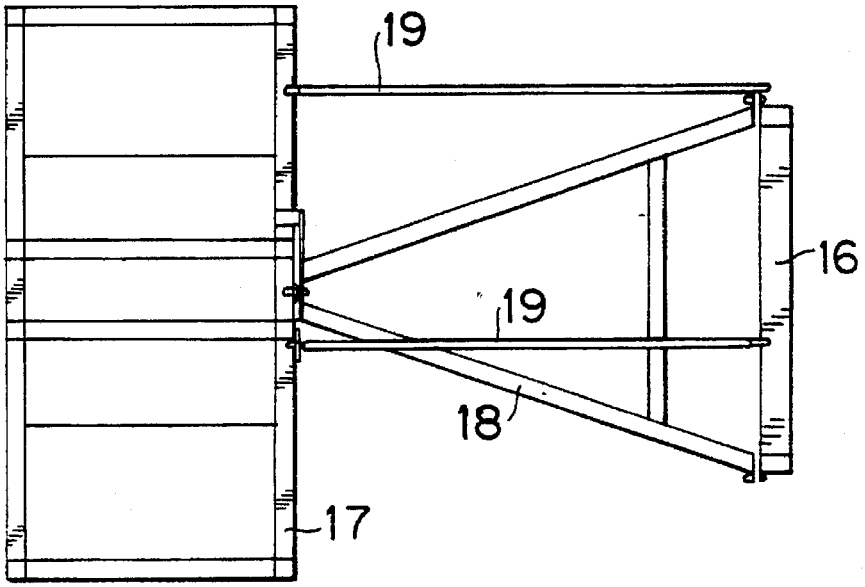
FIG. 4 presents a bogie frame and support arms guiding it and a suspension triangle in top view.

FIG. 4 presents separately the mounting of the bogie frame 17 on the frame 16 with the aid of the suspension triangle 18 and the support arms 19.

Figure 6:
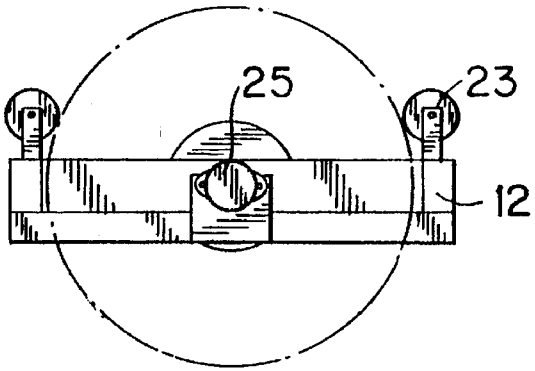
FIG. 6 presents a wash brush and the supporting frame thereof viewed at the end of the brush.
Figure 5:
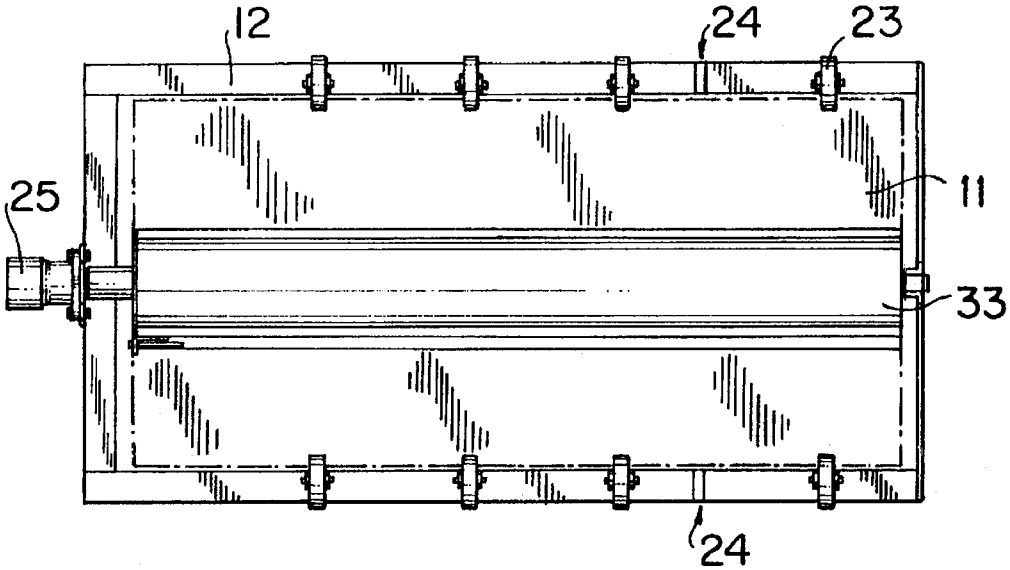
FIG. 5 presents a scrubbing brush and the supporting frame thereof in top view. The air container placed within the scrubbing brush is not separately visible.

FIGS. 5 and 6 present the bearing points 24 of the brush frame 12, wherefrom the frame has been bearably carried to the bogie frame 17. The brush is rotated by an engine 25 attached to the frame 12. The support rollers 23 prevent the boat bottom from touching the frame 12. Inside the brush, e.g., inside a shaft of the brush 11, air containers 33 may also be placed to act as floats.

Figure 8:
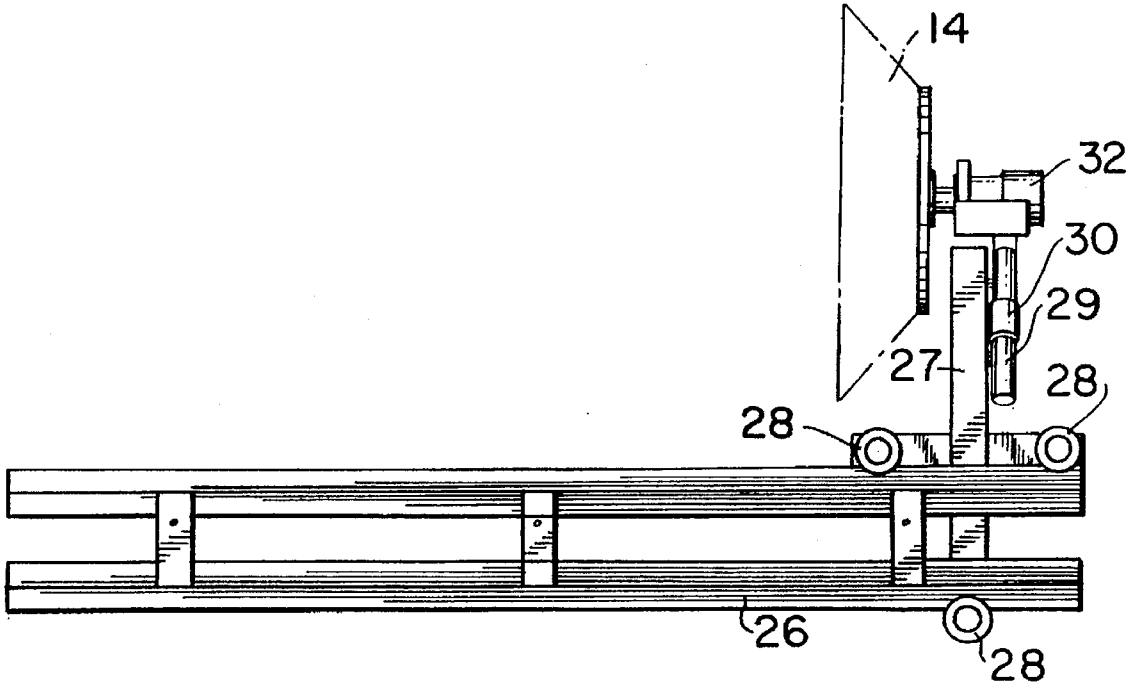
FIG. 8 presents a side scrubbing brush in the travelling direction of the boat.
Figure 7:
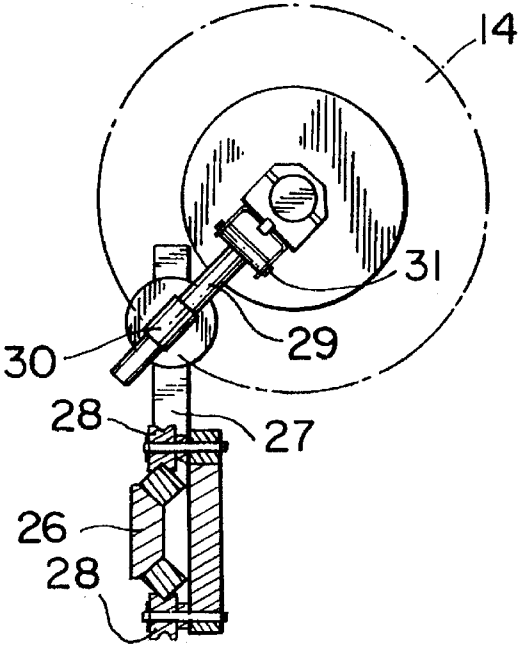
FIG. 7 presents a side scrubbing brush viewed on the side of the boat.

FIGS. 7 and 8 show the manner of fixing a side scrubbing brush 14 and the bearing thereof. The support 27 of the side brush moves supported by rollers 28 along the guide 26 fixed on the frame 12 of the brush. The shaft 29 of the side brush is enabled to rotate in the sleeve 30. The side brush itself has been bearably carried with an articulation 31 to the shaft 29. The brush is rotated by an engine 32.

The operation of a boat washing means according to the invention is as follows.

A boat to be washed is driven between the control beams 15. The control beams also act as service bridges wherefrom e.g. the stem traction means of the boat can be washed with a manual washing means. The boat is conducted to the scrubbing brushes by the engine power of its own or pulled by a separate winch not shown in the figures. The depth of the washing means in the water is regulated with the aid of the buoyancy of a float 21. The mutual angle of the brushes 11 when the brushes are still free of the contact with the boat is set with the aid of floats 22 and the buyoancy of the air containers within the brushes. The buyoancy is increased or decreased by pumping air into the floats or the air containers or by letting it out, so that the floats are partly filled with water.

A first pair of brushes 11 sinks down because of the weight of the boat. The scrubbing brushes 11 are depressed against the bottom of the boat due to the effect of the floats 21 and 22 and the buyoancy generated by the air containers within the brushes. The bogie frame 17 turns because of the boat weight so that in the travelling direction of the boat the first pair of brushes sinks down and the second pair of brushes rises up. The suspension triangle 18 permits the bogie frame 17 to sink as the boat depresses the scrubbing brushes 11 down. The support shafts 19 have been bearably carried to be resilient at both ends. They keep the bogie frame 17 in upright position when the bogie frame is sinking but permit the bogie frame rotate around the bearing at the tip of the suspension triangle 18 and at the same time, around the cross-sectional axis of the boat, so that the first pair of brushes sinks and the second one rises. Thus, the brushes settle to conform to the boat bottom in the longitudinal direction of the boat. Each brush 11 settles in the right position transversally to the boat by rotating around the bearing point 24 of the brush frame 12. The boat moves forward through the washing means either pushed by the rotating movement of the brushes or pulled by a separate winch. The support rollers 23 prevent the bottom of the boat from becoming at no phase into contact with the frames or other support structures.

The side brushes 14 conform to the side of the boat due to the effect of gravitation or spring force and move forced by the boat side along the guide 26, and settle, pressed by the spring force, in the direction of the side by rotating around the articulations 30 and 31.

The invention is not confined to the embodiment presented in the foregoing, and a plurality of modifications are conceivable within the scope of the inventive idea defined by the claims. The means is described above as a so-called mobile version, which is easy to convey on wheels of its own. The means may equally be implemented in the form of a fixed installation, whereby the frame 16 and side pontoons 13 are omitted and the suspension triangle 18 and the support arms 19 are fixed directly e.g. on a quay construction. The means may also be implemented without side brushes 14 and guide beams 15.

I claim:

1. A floatable washing apparatus for washing a boat, comprising a frame construction, a plurality of floats arranged in association with said frame construction for providing buoyancy to said frame construction when said frame construction is situated in water, at least first and second pairs of rotatable scrubbing brushes, said second pair of scrubbing brushes being arranged after said first pair of scrubbing brushes in a longitudinal direction which corresponds to the longitudinal direction of the boat, a plurality of support frames each rotatably supporting one of said scrubbing brushes, a rotatable bogie frame for rotatably supporting said support frames, and mounting means for mounting said bogie frame on said frame construction such that said bogie frame is rotatable about a transverse axis substantially perpendicular to a longitudinal axis of said frame construction which corresponds to a longitudinal axis of the boat and said first and second pairs of scrubbing brushes are movable relative to each other, said mounting means comprising a suspension triangle coupled to said bogie frame and said frame construction and extending between said bogie frame and said frame construction, and elongate support shafts each having a first end articulated with respect to said bogie frame and a second end articulated with respect to said frame construction.

2. The apparatus of claim 1, further comprising bearings for rotatably coupling said support frames to said bogie frame such that said support frames rotate about an axis transverse to the longitudinal axis of said frame construction whereby upon rotation of said support frames, said scrubbing brushes are engageable with a bottom of the boat.

3. The apparatus of claim 1, wherein a depth position of said frame construction in water is adjusted by means of said floats.

4. The apparatus of claim 1, wherein said scrubbing brushes each include an air container adapted to provide buoyancy to said scrubbing brush.

5. The apparatus of claim 1, further comprising a side scrubbing brush connected to one of said support frames and adapted to engage with and scrub a side of the boat.

6. The apparatus of claim 5, further comprising support means for supporting said side scrubbing brush, said support means comprising at least one rotatable roller, and movement means for enabling movement of said side scrubbing brush in a direction transverse to the longitudinal direction of said frame construction, said movement means comprising at least one movement guide arranged on said one of said support frames, said at least one roller of said side scrubbing brush support means being arranged to roll along one of said at least one movement guide.

7. The apparatus of claim 5, further comprising rotation means for rotating said side scrubbing brush.

8. The apparatus of claim 1, further comprising a first side scrubbing brush connected to a first one of said support frames and adapted to engage with and scrub a first side of the boat and a second side scrubbing brush connected to a second one of said support frames and adapted to engage with and scrub a second side of the boat opposite to said first side of the boat.

9. The apparatus of claim 1, further comprising guide means coupled to said frame construction for guiding the boat into engagement with said scrubbing brushes.

10. The apparatus of claim 1, further comprising rotation means for rotating said scrubbing brushes such that the boat is moved over said scrubbing brushes by means of the rotational movement of said scrubbing brushes.

11. The apparatus of claim 1, further comprising contact prevention means for preventing the boat from contacting said support frames when the boat moves over said scrubbing brushes, said contact prevention means comprising rollers arranged on an upper surface of said support frames.

12. The apparatus of claim 1, wherein said at least first and second pairs of brushes comprises only first and second pairs of brushes, said plurality of support frames comprising four support frames arranged two each in first and second rows and two each in first and second columns.

13. The apparatus of claim 1, further comprising rotation means arranged in connection with each of said brushes for rotating said brush, said rotation means comprising an engine attached to each of said support frames.

14. The apparatus of claim 1, further comprising side pontoons for supporting said frame construction in the water.

* * * * *